US009089189B1

(12) United States Patent
Davis

(10) Patent No.: US 9,089,189 B1
(45) Date of Patent: Jul. 28, 2015

(54) STRETCHABLE SLIDE FASTENER

(71) Applicant: IDEAL Fastener Corporation, Oxford, NC (US)

(72) Inventor: Gary Davis, Oxford, NC (US)

(73) Assignee: IDEAL Fastener Corporation, Oxford, NC (US)

( * ) Notice: Subject to any disclaimer, the term of this patent is extended or adjusted under 35 U.S.C. 154(b) by 259 days.

(21) Appl. No.: 13/790,152

(22) Filed: Mar. 8, 2013

Related U.S. Application Data

(60) Provisional application No. 61/609,070, filed on Mar. 9, 2012.

(51) Int. Cl.

| | |
|---|---|
| ***A44B 19/24*** | (2006.01) |
| ***A44B 19/34*** | (2006.01) |
| ***A44B 19/08*** | (2006.01) |

(52) U.S. Cl.
CPC ..... *A44B 19/346* (2013.01); *A44B 19/08* (2013.01)

(58) Field of Classification Search
CPC ..... A44B 19/343; A44B 19/346
See application file for complete search history.

(56) References Cited

U.S. PATENT DOCUMENTS

| | | | | |
|---|---|---|---|---|
| 4,052,866 | A * | 10/1977 | Saunders | 66/193 |
| 4,378,683 | A * | 4/1983 | Matsuda et al. | 66/193 |
| 2008/0209694 | A1* | 9/2008 | Horikawa et al. | 24/381 |
| 2008/0289156 | A1* | 11/2008 | Lewis et al. | 24/381 |

* cited by examiner

*Primary Examiner* — Jack W Lavinder
(74) *Attorney, Agent, or Firm* — Neal Wolgin; Tillman Wright PLLC

(57) ABSTRACT

Slide fasteners (zippers) used for certain applications function better if the zipper tape can stretch in the lateral direction. When a zipper is used to close certain articles such as luggage, boots, or certain garments, it can be difficult to easily and fully close a zipper if there is a significant lateral load pulling at the tapes perpendicular to the direction that the slider is pulled. By using a zipper that includes a zipper tape that stretches in the lateral direction, it is possible to more easily close such articles while maintaining a neat appearance of the zipper on the article.

15 Claims, 3 Drawing Sheets

STRETCHABLE SLIDE FASTENER

CROSS-REFERENCE TO RELATED APPLICATION

The present application is a U.S. non-provisional patent application of, and claims priority under 35 U.S.C. §119(e) to, U.S. provisional patent application Ser. No. 61/609,070 filed Mar. 9, 2012, which provisional patent application is incorporated by reference herein.

COPYRIGHT STATEMENT

All of the material in this patent document is subject to copyright protection under the copyright laws of the United States and of other countries. The copyright owner has no objection to the facsimile reproduction by anyone of the patent document or the patent disclosure, as it appears in the Patent and Trademark Office patent file or records, but otherwise reserves all copyright rights whatsoever.

BACKGROUND OF THE INVENTION

1. Field of the Invention

The present invention generally relates to slide fastener chain that includes fabric and features that allow the zipper tapes to stretch in the lateral direction. Slide fastener chain is the combination of two slide fastener tapes and fastener elements mounted thereon, and that is manufactured in bulk lengths. A slide fastener assembly, or zipper, is made by cutting a desired length of chain, mounting a slider assembly, and optionally adding top and/or bottom stops, pin boxes, etc.

There are a number of applications for slide fasteners that incorporate tapes that can stretch, such as clothing, luggage, and footwear. A conventional zipper must be very stable in the longitudinal direction (along its length) in order that the teeth of the opposing tapes properly engage, and are generally also very stable in the lateral direction (across its width). A zipper that can stretch in the lateral direction, but be stable in the longitudinal direction, is less likely to fail due to the teeth becoming disengaged when closed because the fabric tape can absorb some of the stress that would otherwise bear on the teeth. The use of such a zipper is desirable in luggage as it makes it easier to close the zipper on a fully loaded or overloaded bag. Such a zipper can also be used in applications where some amount of give is desirable even if the lateral stress is minimal, such as a dress. In one application, slide fasteners made from tapes of the present invention are used as a closure for luggage. In other applications such zippers may be use for garments such as pants or dresses. Other applications include zippers for the sides of tall form-fitting boots.

There have been many attempts at making a zipper with tapes that allow for significant lateral stretch. There have been some such zipper products that have had modest success in the marketplace, but these products have suffered from poor performance due to inadequate stretch (in proportion to the tape width), lack of rebound (the ability of the tape to quickly and repeatedly return to its non-stretched width), and lack of durability. A need exists for improvement in the field of stretchable slide fastener chain that address the shortcomings of the prior art, and from which stretchable slide fastener assemblies (zippers) may be made. This and other needs are addressed by one or more aspects of the present invention.

2. Description of Related Art

There are numerous means for making a zipper stretchable in the lateral direction by using fabric tapes that are made from stretchable weaving yarns. While such fabrics are readily available, they are not suitable for use in a zipper unless the tape is stable (non-stretchable) in the longitudinal direction (the length of the zipper from pin box to top-stop for instance). In order to weave a zipper tape, the warp weaving yarns are aligned in the longitudinal direction, and the weft weaving yarns are aligned perpendicular to the warp yarns. Since any stretch in the longitudinal direction of the zipper would allow the zipper teeth of a finished zipper assembly to become disengaged, extremely stable (no longitudinal stretch) warp weaving yarns are required. The challenge in producing a zipper tape that stretches in the direction of the weft weaving yarns is to use weaving yarns that have nominal, repeatable stretch. Excessive stretch in the lateral direction can create performance issues that interfere with the proper movement of the zipper slider and can result in dislocations between opposing fastener elements (teeth).

Stretchable tapes have been made using a variety of stretchable weft weaving yarns that include stretchable fibers such as spandex. However, tapes of the prior art that use stretchable fibers do not exhibit sufficient stretch (in terms of the ratio of the stretched width to the un-stretched width of the tape), or are not durable due to failure of the stretchable weft weaving yarns (during weaving, or during use due to physical abrasion or laundering or drying heat), or loss of stretch memory (the ability of the stretched tape to return to the original un-stretched tape width quickly and repeatedly). Therefore, it is an objective of the present invention to create a slide fastener using fabric tapes that have the desired stretch characteristics (ratio of stretched to un-stretched tape width) and acceptable durability.

The slide fastener chain and tapes of the present invention provides for a sufficient degree of stretchability and durability.

SUMMARY OF THE INVENTION

The zipper of the present invention accomplishes the above objectives as described below.

In one embodiment of the present invention, the slide fastener tapes are woven using inelastic warp weaving yarns and elastic weft weaving yarns. The inelastic warp weaving yarns are made from textured polyester yarn. The elastic weft weaving yarns are made from a stretchable fiber such as spandex, and wrapped with textured filament polyester for weavability and durability. Other factors that determine the stretch characteristics of the finished tape are the weight of the textured filament polyester, the number of strands of the core stretch fiber and the wrapping fibers, and the means of wrapping the stretch fiber with textured filament polyester. In addition, the weave pattern of the finished zipper tape further affects the stretch characteristics of the finished zipper assembly. In one embodiment of the present invention, a no point twill pattern allows for the desired degree of stretch and a smooth feel and attractive appearance. A single point or two point twill is also acceptable from an aesthetic perspective, but the transitions in the weaving patter (the twill points) result in significantly less stretch across the tape width in proportion to the un-stretched width.

BRIEF DESCRIPTION OF THE DRAWINGS

One or more preferred embodiments of the present invention now will be described in detail with reference to the accompanying drawings, wherein the same elements are referred to with the same reference numerals.

DETAILED DESCRIPTION

Figure 1:
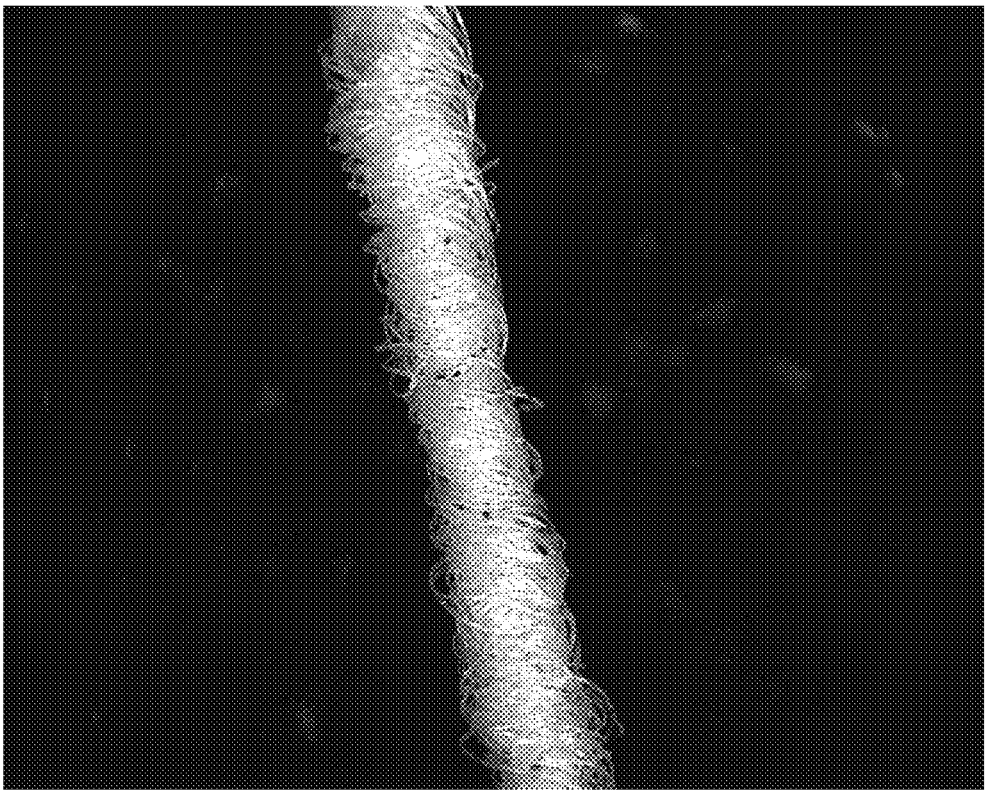
FIG. 1 is a photo showing un-stretched weft weaving yarns used in the slide fastener tape of the present invention.

As a preliminary matter, it will readily be understood by one having ordinary skill in the relevant art (an "Ordinary Artisan") that the present invention has broad utility and application. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended to, nor is to be construed to, limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 2:
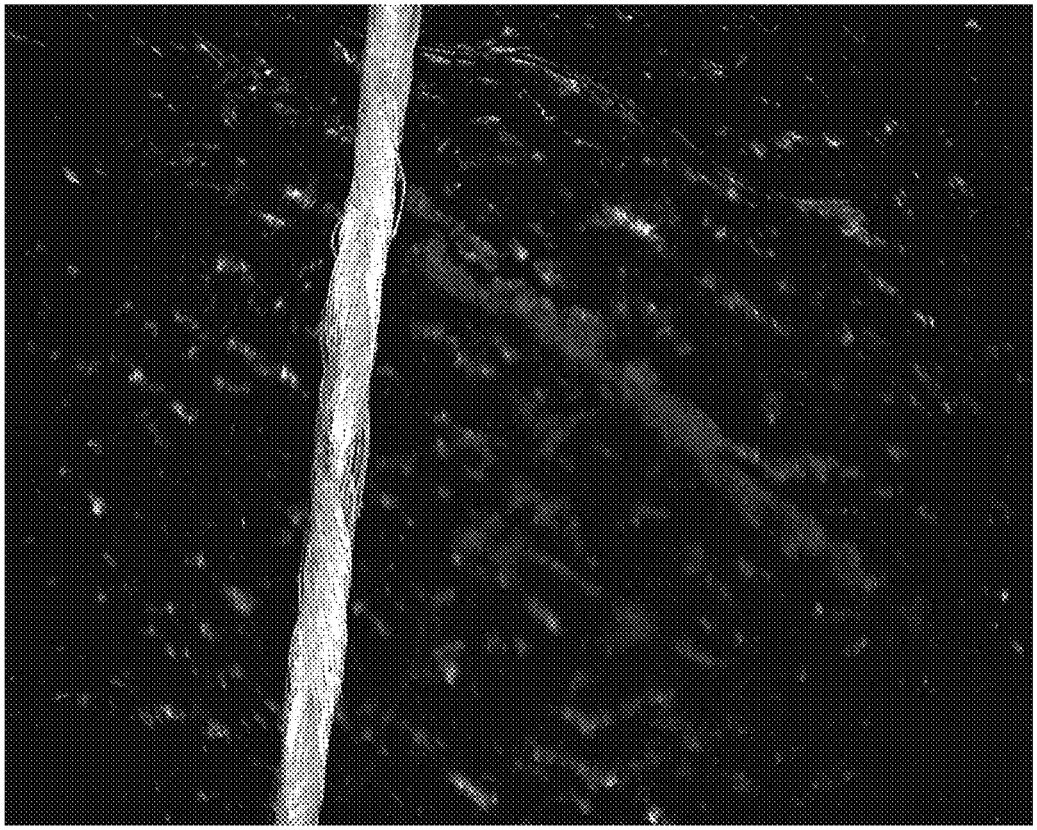
FIG. 2 is a photo showing stretched weft weaving yarns used in the slide fastener tape of the present invention.
Figure 3:
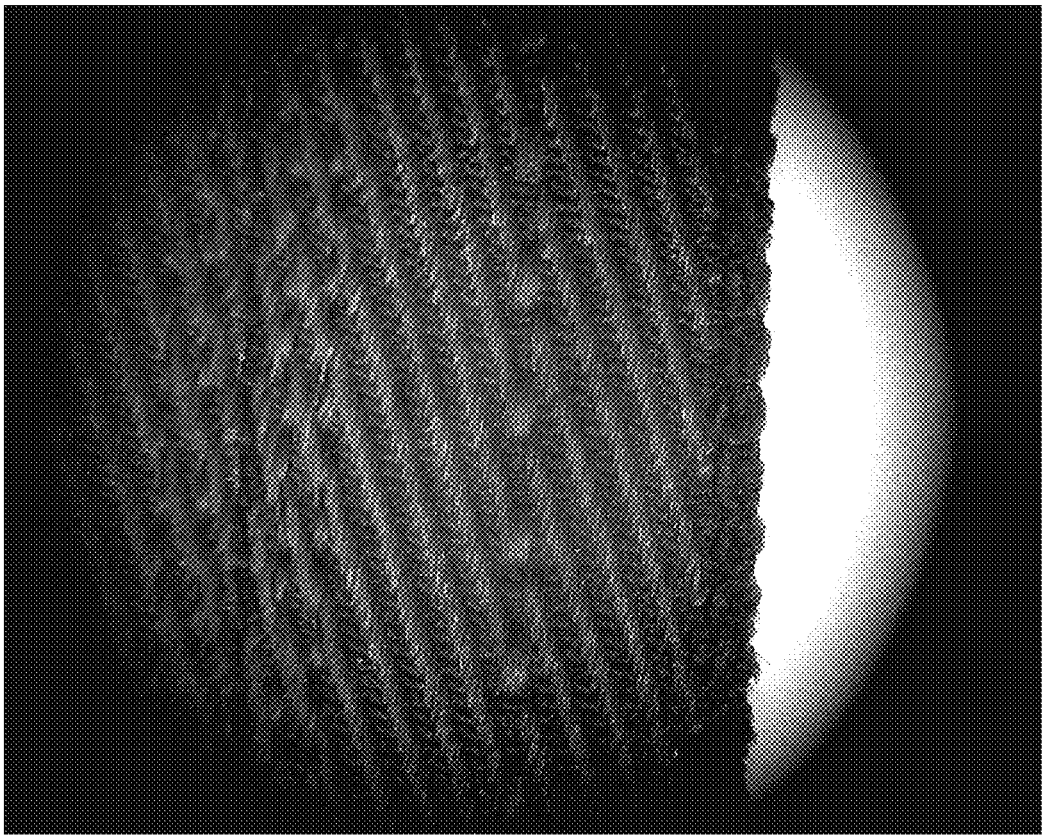
FIG. 3 is an illustration showing the outward appearance of un-stretched slide fastener tape of the present invention.

FIG. 1 illustrates the weft weaving yarns, in an un-stretched state, used to weave the slide fastener tape of the present invention. FIG. 2 illustrates the weft weaving yarns, in a highly stretched state, used to weave the slide fastener tape of the present invention. FIG. 3 illustrates an example of finished slide fastener tape of the present invention in an un-stretched state and further showing the finished twill pattern.

In one embodiment of the present invention, the slide fastener tapes are woven using inelastic warp weaving yarns and elastic weft weaving yarns. The inelastic warp weaving yarns are made from textured polyester yarn. The elastic weft weaving yarns are made from spandex fiber wrapped with textured filament polyester. Other factors that determine the stretch characteristics of the finished tape are the weight of the textured filament polyester, the number of strands of the cord (stretch fiber) of the weft yarns, the number of wrapping filaments, and the means of wrapping. In addition, the weave pattern further affects the stretch characteristics of the finished tape. In one embodiment of the present invention, a no point twill pattern allows for the desired degree of stretch and a smooth finished fabric feel and attractive appearance. A single point or two point twill is also acceptable, but such a twill pattern results in significantly less stretch in proportion to the un-stretched tape width.

In one embodiment of the present invention, the warp weaving yarns are dimensionally stable 2/150 polyester, and the weft weaving yarns comprises a spandex core with core-spun textured filament polyester wrapped around the spandex core. It has been determined that a weft weaving yarn of 260 denier spandex with 56 picks of 70 denier textured polyester wrapper fibers with 34 filaments in the wrapper yarn (specified as 260/1/70/34) results in the desired characteristics.

In other embodiments, it is possible to create a lighter tape (which exhibits more stretch) or a heavier tape (which exhibits less stretch) by altering the denier of the core spandex. It has been determined that other embodiments of the present invention that exhibit acceptable stretch characteristics may be obtained with core spandex yarn of 100 denier to 1,040 denier. The number of filaments of wrapper yarn may also vary, with acceptable results using as few as 30 filaments and up to 48 filaments. For instance, a lighter tape may be produced using textured polyester wrapped spandex as light as 100/1/70/34, and a heavier tape may use textured polyester wrapped spandex as heavy as 1040/1/70/48.

In one embodiment of the present invention, a no point twill pattern allows for the desired degree of stretch and a smooth feel and attractive appearance. The preferred weave pattern is created by weaving the tape with a 3-5 cam pattern. For a one inch nominal finished tape width (un-stretched), a preferred pattern uses 44 ends of warp weaving yarns and a double pick filling, resulting in 56 picks per inch. A selvedge edge is incorporated into the pattern to allow for a strong sewing edge for sewing the tape to a garment. In one embodiment of the present invention, the stretch ratio of the finished tape, that is the ratio of the stretched to un-stretched tape width, is 1.48:1.

The slide fastener tape of the present invention can by dyed after weaving using conventional dyeing means that use elevated temperature and pressure. By way of example, it has been found that a dyeing temperature of 265 degrees Fahrenheit and dye vessel pressure of 55 pounds per square inch (psi) results in ideal dyeing characteristics, but a temperature range of 240-275 degrees Fahrenheit and pressure of 30-65 psi is acceptable.

In order to make slide fastener assemblies (zippers) with lateral stretch, the first step is to make slide fastener tapes that exhibit the desirable properties of the tapes of the present invention. The stretchable fabric tapes of the present invention are woven in the manner described above. While it is possible to use the stretchable fabric tapes of the present invention to make a variety of zipper types such as metal zippers (metal teeth), molded zippers (plastic teeth made from Delrin® or other materials), and coil zippers (fastener elements, or "teeth", made from coiled polyester monofilament), it is generally recognized that coil zippers have the strongest lateral strength (that is, for any given gauge or size of zipper, coil-type teeth have the greatest resistance to the opposing teeth separating due to lateral stresses). In addition, the types of applications for which a stretchable zipper are most desired such as luggage, dresses, footwear, and dress slacks, generally use coil-type zippers due to their positive attributes related to cost, ease of dyeing, and appearance.

For a coil-type zipper, once the stretchable tapes have been woven, two stretchable tapes are fed into a coil zipper spiraling machine in parallel. Two parallel lengths of monofilament and two lengths of cord are also fed into the coil zipper spiraling machine, and one strand of monofilament is coiled around each of the cords and formed into opposing fastener elements. The two lengths of coiled monofilament are meshed together, aligned with the 2 lengths of tape, and then sewn to the tape. This results in stretchable slide fastener chain comprising the two tapes and two coils (with the opposing coils engaged). The slide fastener chain is then typically dyed as desired. To make finished zipper assemblies, the desired length of stretchable chain is cut from a bulk roll, a slider is added, and then further processed to add a pin box, top of bottom stops, and the like, resulting in stretchable zippers of the desired length.

What is claimed is:

1. A slide fastener tape, wherein:

the warp yarn is inelastic and the weft yarn is elastic, resulting in a tape that is dimensionally stable in the longitudinal direction and dimensionally elastic in the lateral direction;

the warp yarn is textured polyester and the weft yarn comprises a spandex core wrapped with textured polyester filaments; and the spandex core of the weft yarn has a thickness of about 260 denier, and is wrapped with at least 34 filaments of textured polyester.

2. The slide fastener tape of claim 1 wherein the spandex core of the weft yarn is wrapped with no more than 48 filaments of textured polyester.

3. The slide fastener tape of claim 1 wherein the warp yarns are dimensionally stable polyester that has a thickness of about 150 denier.

4. The slide fastener tape of claim 3 wherein the warp and weft yarns are weaved in a no point twill pattern.

5. The slide fastener tape of claim 4 wherein the twill pattern comprises a 2/1 weave.

6. The slide fastener tape of claim 5 wherein the outer edge is finished in a selvedge edge.

7. A slide fastener chain comprising:

two parallel lengths of laterally stretchable slide fastener tape; and two parallel lengths of slide fastener elements (teeth);

wherein said slide fastener tape is woven from warp yarn that is textured polyester and weft yarn that comprises a spandex core wrapped with textured polyester filaments;

wherein the weft yarn of said slide fastener tape has a spandex core with a thickness of at least 100 denier but less than 1040 denier; and wherein the spandex core of the weft yarn is wrapped with at least 30 filaments of textured polyester but no more than 48 filaments of textured polyester.

8. The slide fastener chain of claim 7 wherein the spandex core of the weft yarn has a thickness of about 260 denier, and is wrapped with at least 34 filaments of textured polyester.

9. A slide fastener chain comprising:

two parallel lengths of laterally stretchable slide fastener tape; and two parallel lengths of slide fastener elements (teeth); and wherein said slide fastener tape is woven from warp yarn that is textured polyester and weft yarn that comprises a spandex core wrapped with textured polyester filaments, and wherein said weft yarn of said slide fastener tape has a spandex core with a thickness of 100 denier but less than 1040 denier and is wrapped with at least 30 filaments of textured polyester but no more than 48 filaments of textured polyester.

10. The slide fastener chain of claim 9 wherein the slide fastener tapes can stretch laterally with a stretched to unstretched width ratio of at least 1.3:1.

11. The slide fastener chain of claim 9 wherein the slide fastener tapes can stretch laterally with a stretched to unstretched width ratio of at least 1.48:1.

12. The slide fastener chain of claim 9 wherein the slide fastener tapes are woven from undyed weft and warp yarns, and the chain is subsequently dyed.

13. The slide fastener chain of claim 12 wherein the chain is subsequently dyed at a temperature of between 240-275 degrees Fahrenheit and an atmospheric pressure of between 30-65 pounds per square inch.

14. The slide fastener chain of claim 13, wherein the slide fastener tapes can stretch laterally with a stretched to unstretched width ratio of at least 1.3:1.

15. The slide fastener chain of claim 14 wherein the slide fastener tapes can stretch laterally with a stretched to unstretched width ratio of at least 1.48:1.

* * * * *